US005695898A

United States Patent [19]

Go et al.

[11] Patent Number: 5,695,898

[45] Date of Patent: Dec. 9, 1997

[54] ELECTROPHOTOGRAPHIC PHOTOSENSITIVE MEMBER, ELECTROPHOTOGRAPHIC APPARATUS AND DEVICE UNIT HAVING IT

[75] Inventors: Shintetsu Go, Yokohama; Koichi Suzuki, Kawasaki; Kazuma Sato, Yokohama; Akira Shimada, Tokyo, all of Japan

[73] Assignee: Canon Kabushiki Kaisha, Tokyo, Japan

[21] Appl. No.: 674,197

[22] Filed: Jul. 1, 1996

Related U.S. Application Data

[63] Continuation of Ser. No. 174,466, Dec. 28, 1993, abandoned.

[30] Foreign Application Priority Data

Dec. 28, 1992 [JP] Japan ..... 4-358817

[51] Int. Cl.[6] ..... G03G 8/00; G03G 15/00

[52] U.S. Cl. ..... 430/66; 430/67; 399/159

[58] Field of Search ..... 430/66, 67; 399/159, 399/130

[56] References Cited

U.S. PATENT DOCUMENTS 3,736,133 5/1973 Weigl et al. ..... 430/1.5

4,426,435 1/1984 Oka ..... 430/66

5,278,013 1/1994 Kashizaki et al. ..... 136/249

FOREIGN PATENT DOCUMENTS 460558 12/1991 European Pat. Off. ..... G03G 5/147

464749 1/1992 European Pat. Off. ..... G03G 5/05

2229517 12/1972 Germany ..... G03G 5/147

OTHER PUBLICATIONS

Patent Abstracts of Japan, vol. 10, No. 190 (P–474) Jul. 1986 of JPA61–036755.

Patent Abstracts of Japan, vol. 6, No. 22 (P–101) Feb. 1982 of JPA–56–143443.

Patent Abstracts of Japan, vol. 11, No. 256 (P–607) Aug. 1987 of JPA62–061057.

*Primary Examiner*—Kathleen Duda

*Attorney, Agent, or Firm*—Fitzpatrick, Cella, Harper & Scinto

[57] ABSTRACT

An electrophotographic photosensitive member having a protective layer which comprises electroconductive particles and a binding resin, wherein the difference between the reflex indices of the electroconductive particles and binding resin is 0.3 or less.

12 Claims, 1 Drawing Sheet

ELECTROPHOTOGRAPHIC PHOTOSENSITIVE MEMBER, ELECTROPHOTOGRAPHIC APPARATUS AND DEVICE UNIT HAVING IT

This application is a continuation of application Ser. No. 08/174,466 filed Dec. 28, 1993, now abandoned.

BACKGROUND OF THE INVENTION

1. Field of the Invention

The present invention relates to an electrophotographic photosensitive member, and more specifically, it relates to an electrophotographic photosensitive member having a protective layer containing conductive particles, an electrophotographic apparatus and a facsimile having the electrophotographic photosensitive member.

2. Related Background Art

An electrophotographic photosensitive member should have, needless to say, necessary sensitivity, electrical properties, optical properties and the like in compliance with the applied electrophotographic process. In addition, the surface of the electrophotographic photosensitive member to which electrical and mechanical external forces are directly applied in repetition during corona charging, toner development, the transfer of an image to the recording paper, cleaning and the like, should have the durability to these external forces.

Specifically, there is required endurance to scratch formation on the surface of the photosensitive member due to friction, and to the deterioration of the surface of the photosensitive member by ozone generated during corona charging, and the like. Furthermore, there is the problem of the toner adhesion to the photosensitive member which is caused by repeating toner development, cleaning and the like. In order to solve this problem, it is required to improve the cleaning properties of the surface of the photosensitive member. Particularly required for the photosensitive member is the durability to resist the surface adhesion of corona products such as ozone and $NO_x$ often generated during repeating charging particularly under high humidity conditions, which cause a resistance drop.

To achieve these required characteristics of the surface of the photosensitive member, it has been attempted to form a protective resin layer on the photosensitive layer. For example, Japanese Patent Application Laid-open No. 57-30843 has proposed a protective layer of which resistance is controlled by adding metal oxide particles as the conductive particles.

Conventionally, however, the particles cannot be sufficiently dispersed in a binding resin, which results in adverse influences on the conductive properties and on the transparency of the protective layer. In consequence, there might arise phenomena such as the image defect due to the uneven protective layer as well as the rise of residual potential and the deterioration of the sensitivity through repeating use. Moreover, even when the particles are uniformly dispersed in the protective layer, scattering of the incident light occurs owing to the dispersed particles, which Gives rise to the deterioration of the layer transparency and image quality and the changes in potential properties.

Heretofore, in order to prevent light scattering and to obtain the protective layer with high transparency, it is known to use the particles having a particle diameter smaller than the wavelength of the incident light. There is the tendency, however, that the smaller the particle diameter of the particles, the easier the cohesion of the particles. This makes uniform dispersion of the particles more difficult. Furthermore, even after the dispersion, the secondary cohesion and the sedimentation of the particles are liable to occur. For these reasons, it has been very difficult to produce stable dispersions.

As the image quality and the durability of the photosensitive members have been fairly improved in recent years, the electrophotographic photosensitive member satisfying the characteristics in the higher level have now been investigated.

SUMMARY OF THE INVENTION

An object of the present invention is to provide an electrophotographic photosensitive member having a protective layer having excellent transparency.

Another object of the present invention is to provide an electrophotographic photosensitive member which can stably give excellent images, even if repeatedly used.

Still another object of the present invention is to provide an electrophotographic photosensitive member which can give excellent images under environments ranging from low temperature-low humidity to high temperature-high humidity.

A further object of the present invention is to provide an electrophotographic apparatus and a device unit having the above-mentioned electrophotographic photosensitive member.

That is, the present invention is directed to an electrophotographic photosensitive member comprising an electroconductive support, a photosensitive layer on the electroconductive support and a protective layer provided on the photosensitive layer, said protective layer being composed of electroconductive particles and a binding resin, wherein the difference between the refractive indices of the electroconductive particles and the binding resin is 0.3 or less.

Furthermore, the present invention is also directed to an electrophotographic apparatus and a device unit having the above-mentioned electrophotographic photosensitive member.

DETAILED DESCRIPTION OF THE INVENTION

Figure 1:
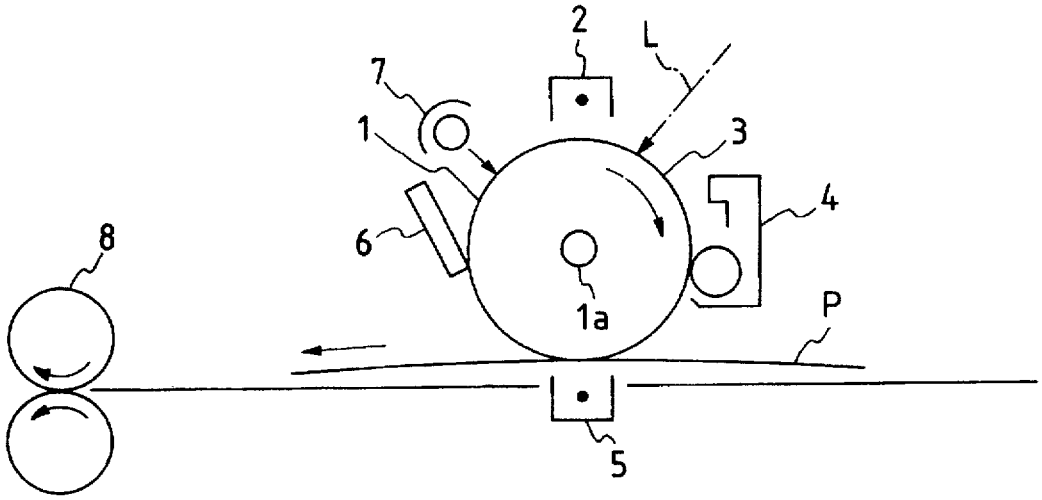
FIG. 1 shows an exemplary schematic constitution of an electrophotographic apparatus having an electrophotographic photosensitive member of the present invention.

An electrophotographic photosensitive member of the present invention has a protective layer containing electroconductive particles and a binding resin.

In the present invention, the difference between the refractive indices of the conductive particles and the binding resin is preferably 0.3 or less, more preferably 0.2 or less. The values of the refractive index in the present invention are measured with Abbe refractometer (ATAGO-1T, made by ATAGO Co., Ltd).

The above-mentioned conductive particles can be prepared by imparting electroconductivity properties to base particles. The method of imparting the conductive properties includes doping of the base particles with a conductive material, and coating of the base particles with a conductive material to form a thin layer on the base particles. Of the two processes, the latter coating process is more preferable in point of easy manufacturing.

As the base particles, any particles can be used, so long as the difference between the refractive index of the conductive particles obtained therefrom and that of the binding resin is 0.3 or less. Preferable examples of the base particles are inorganic materials such as silicon oxide ($SiO_2$, $n_D$ (refractive index): 1.5), aluminum oxide ($Al_2O_3$, $n_D$: 1.7), barium sulfate ($BaSO_4$, $n_D$: 1.6), magnesium oxide (MgO, $n_D$: 1.7), niter ($KNO_3$, $n_D$: 1.5), soda-niter ($NaNO_3$, $n_D$: 1.6), gypsum ($CaSO_4$, $n_D$: 1.5) and mica ($n_D$: 1.6); and organic materials such as polyamides, phenolic resins and polyethylene fluoride. In the present invention, the inorganic base particles are preferable, because materials such as the solvent etc. can be selected in a wide range. Above all, barium sulfate is preferable because of its particularly excellent dispersibility and dispersion stability.

When the conductive properties is imparted by surface coating, usable examples of the conductive material are metal oxides such as tin oxide, zinc oxide and indium oxide, as well as gold, silver, nickel and aluminum. The thickness of the coating layer is preferably in the range of from 0.002 to 0.1 μm, more preferably from 0.005 to 0.02 μm. If the layer is too thin, sufficient conductivity sometimes cannot be obtained, and on the contrary, if it is too thick, the refractive index may be excessively large. Examples of the technique for forming the layer include a wet process in which a conductive material is precipitated on the surfaces of the base particles, and a vapor deposition process.

The protective layer of the electrophotographic photosensitive member of the present invention has quite excellent transparency. Hence it is not necessary to reduce the particle diameter of the conductive particles to prevent the interference of light. Thus, in the present invention, the average particle diameter of the primary particles of the conductive particles to be dispersed is preferably in the range of from 0.1 to 1.0 μm, more preferably from 0.3 to 0.7 μm in consideration of the dispersibility and dispersion stability.

Furthermore, in the present invention, a surface improver such as a silane coupling agent or a silicone oil may be used for the further improvement of the dispersibility and dispersion stability.

As for the binding resin, any usual general-purpose resin can be used. As described above, however, various kinds of external forces are applied to the surface of the photosensitive member, thus the examples of the preferable binding resin are acrylic resins, epoxy resins, phenolic resins, urethane resins, melamine resins, polyimide resins, silicone resins, polycarbonate and polyamic acid resins. In the present invention, these resins may be used singly or in combination of two or more thereof or a copolymer thereof.

The protective layer of the present invention can be formed by coating the photosensitive layer with a coating material in which the conductive particles are dispersed in the binding resin, followed by drying and curing. The thickness of the protective layer is preferably in the range of from 0.1 to 15 μm, more preferably from 0.5 to 5 μm. Moreover, the volume resistivity of the protective layer which can be used in the present invention is preferably in the range of from $10^{10}$ to $10^{15}$ Ω•cm.

The photosensitive layer in the present invention may be either (1) the lamination type, which comprises a charge-generating layer containing a charge-generating substance and a charge-transporting layer containing a charge-transporting substance; or (2) single layer type which contains a charge-generating substance and a charge-transporting substance in one layer. Further, the former type includes two types according to the lamination order where a charge-generating layer and a charge-transporting layer are formed on the supporting member in this order, or vice versa.

The charge-generating layer may be formed by dispersing a charge-generating substance in a binding resin, and by coating with the dispersion followed by drying. The charge-generating substance includes azo pigments such as monoazo pigments, disazo pigments, trisazo pigments, quinone pigments, quinocyanine pigments, perylene pigments, indigo pigments such as indigo and thioindigo, azulenium salt pigments, and phthalocyanine pigments. The binder resin includes polyvinyl butyral, polyvinylbenzal, polyarylate, polycarbonate, polyester, polystyrene, polyvinylacetate, acrylic resins, polyurethane, polyvinylpyrrolidone, ethylcellulose, and cellulose acetate butylate. The layer thickness of the charge-generating layer is preferably 5 μm or less, more preferably 0.05–2 μm.

The charge-transporting layer may be formed by dissolving a charge-transporting substance in a film-forming resin, and then by applying the solution on a support followed by drying.

The charge-transporting substance includes polycyclic aromatic Compounds having a side chain structure exemplified by biphenylene, anthracene, pyrene or phenanthrene; nitrogen-containing cycles such as indole, carbazole, oxadiazole and pyrazoline; hydrazones and styryl compounds. The film-forming resin includes polyesters, polycarbonates, acrylic resins, polyarylate, acrylonitrile-styrene copolymers, polymethacrylate esters, polystyrene, poly-N-vinylcarbazole and polyvinyl anthracene. The layer thickness of the charge-transporting layer is preferably 5–40 μm, more preferably 10–30 μm.

For the photosensitive layer of single layer type, the above mentioned substances can be used. Further, a charge transferring complex comprising poly-N-vinylcarbazole and trinitrofluorene can be used as the charge-transporting substance. The layer thickness is preferably 5–40 μm, more preferably 10–30 μm.

In the present invention, an intermediate layer can be formed between the photosensitive layer and the protecting layer in order to improve the adhesiveness and paintability. As the material for the intermediate layer, casein, polyvinyl alcohol, nitrocellulose, ethylene-acrylic acid copolymer, alcohol-soluble polyamide, polyurethane, gelatin, aluminium oxide etc. can be used. The layer thickness is preferably 0.1–10 μm, more preferably 0.3–2 μm.

The electroconductive support in the present invention may be made of a metal such as 1 aluminum, aluminum alloy, copper, chrome, nickel, zinc and stainless steel and the alloy thereof; a plastic film laminated with a metallic foil such as aluminum and copper; a plastic film coated with aluminum, indium oxide or tin oxide by vapor-deposition; or a plastic, metal or paper substrate coated with an electroconductive material by itself or with a proper binder resin. The electroconductive material includes particulates, short metal fibers or metal foils such as aluminum, copper, nickel and silver; electroconductive metal oxides such as antimony oxide, indium oxide, and tin oxide; polymeric electroconductive material such as polypyrrole, polyaniline, and polyelectrolytes; carbon fiber, carbon black and Graphite particulates; organic and inorganic electrolytes; and electroconductive particles coated with any of the above mentioned electroconductive materials. The support may be in a drum shape, a sheet shape, a belt type, or in any other form suitable for the electrophotographic apparatus employed.

A subbing layer which serves as a barrier and adhesive may be provided between the electroconductive support and the photosensitive layer of the present invention. The subbing layer may be made from a material as used for the intermediate layer provided between the protective layer and the photosensitive layer. The layer thickness is preferably 0.1–5 μm, more preferably 0.5–3 μm. The subbing layer may contain electroconductive particles of metal, metal oxide, carbon black etc. Alternatively, two subbing layers, one containing electroconductive particles and the other not, can be formed on the electroconductive substrate in this order. In this case, the thickness of the particle-containing subbing layer is preferably 0.1–50 μm. especially 0.5–40 μm.

The layers above mentioned can be formed using a suitable solvent, by dip coating, spray coating, beam coating, spinner coating, roller coating, Meyer-Bar coating, blade coating, followed by drying.

The electrophotographic photosensitive member of the present invention is useful not only for the usual electrophotographic apparatus such as copying machines, laser beam printers, LED printers, and liquid crystal shutter printers, but also useful in a wide application field of electrophotography such as display, recording, light printing, facsimile and laser engraving.

FIG. 1 schematically illustrates an example of the constitution of an electrophotographic apparatus employing the electrophotographic photosensitive member of the present invention.

In FIG. 1, a drum type photosensitive member 1 of the present invention is driven to rotate around the axis 1*a* in the arrow direction at a prescribed peripheral speed. The photosensitive member 1 is uniformly charged positively or negatively at the peripheral face during the rotation by an electrostatic charging means 2, and then exposed to image-exposure light L (e.g. slit exposure, laser beam-scanning exposure, etc.) at the exposure part 3 with an image-exposure means (not shown in the drawing), whereby electrostatic latent images are sequentially formed on the peripheral surface in accordance with the exposed image.

The electrostatic latent image is developed with a toner by a developing means 4. The toner-developed images are sequentially transferred by a transfer means 5 onto a surface of a transfer-receiving material P which is fed between the photosensitive member 1 and the transfer means 5 synchronously with the rotation of the photosensitive member 1 from a transfer-receiving material feeder not shown in the drawing.

The transfer-receiving material P having received the transferred image is separated from the photosensitive member surface, and introduced to an image fixing means 8 for fixation of the image and exiting of the copying machine as a duplicate copy.

The surface of the photosensitive member 1, after the image transfer, is cleaned with a cleaning means 6 to remove any remaining non-transferred toner, and is treated for charge elimination with a pre-exposure means 7 for repeated use for image formation.

In the electrophotographic apparatus, two or more of the constitutional elements of the above described photosensitive member, the developing means, the cleaning means, etc. may be integrated into one device unit, which may be made detachable from the main body of the apparatus. For example, at least one of the charging means, the developing means, and the cleaning means is combined with the photosensitive member 1 into one device unit which is detachable from the main body of the apparatus with the aid of a guiding means such as a rail set in the main body of the apparatus.

When the electrophotographic apparatus is used as a copying machine or a printer, the optical image exposure light L may be projected onto the photosensitive member as reflected light or transmitted light from an original copy, or otherwise the information read out by a sensor from an original may be signalized, and light is projected, onto a photosensitive member, by scanning with a laser beam, driving an LED array, or driving a liquid crystal shutter array according to the signal.

Figure 2:
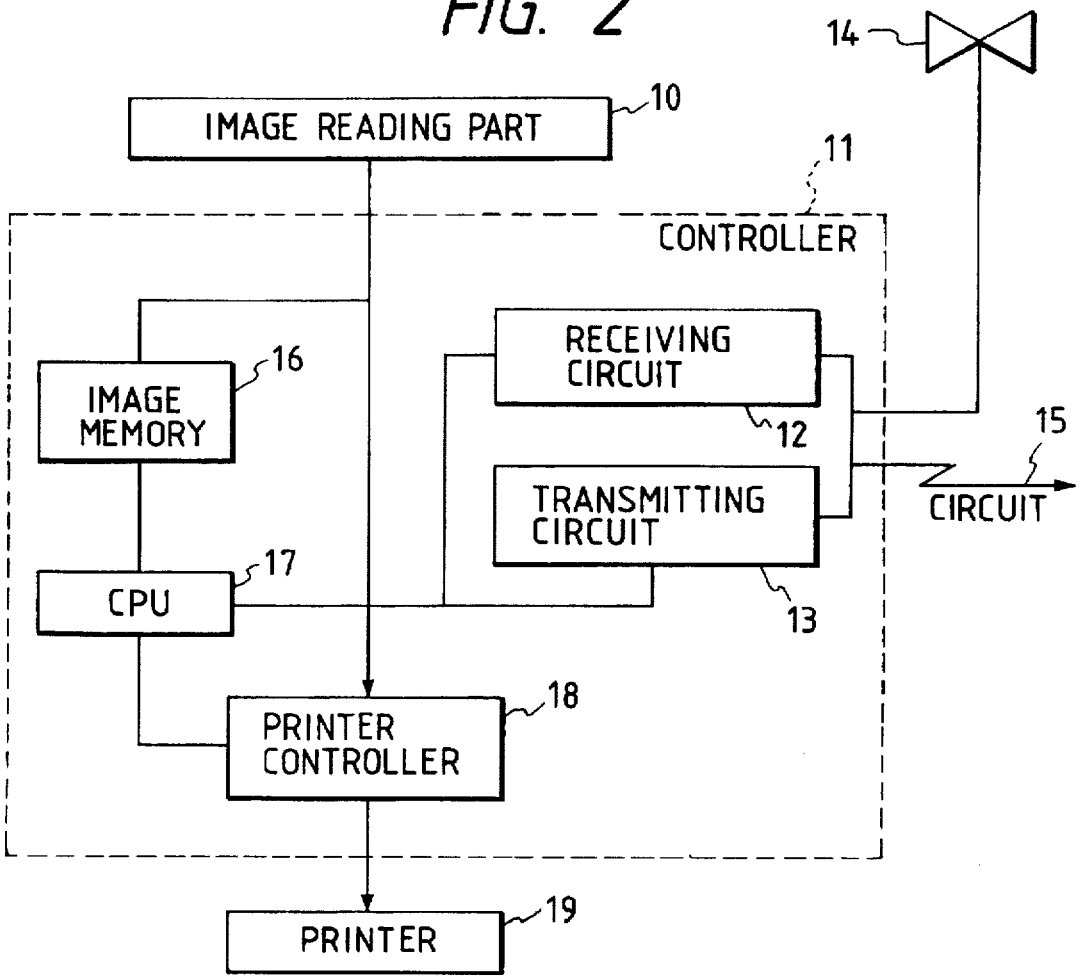
FIG. 2 shows an exemplary block diagram of a facsimile having an electrophotographic photosensitive member of the present invention.

When the electrophotographic apparatus is used as a printer of a facsimile machine, the optical image exposure light L is employed for printing the received data. FIG. 2 is a block diagram of an example of this case.

A controller 11 controls the image-reading part 10 and a printer 19. The entire of the controller 11 is controlled by a CPU 17. Readout data from the image reading part 10 is transmitted through a transmitting circuit 13 to the other communication station. Data received from the other communication station is transmitted through a receiving circuit 12 to a printer 19. The image data is stored in image memory 16. A printer controller 18 controls a printer 19. The numeral 14 denotes a telephone set.

The image received through a circuit 15, namely image information from a remote terminal connected through the circuit, is demodulated by the receiving circuit 12, treated for compounding of the image information in CPU 17, and successively stored in the image memory 16. When at least one page of image information has been stored in the image memory 16, the images are recorded in such a manner that the CPU 17 reads out the one page of image information, and sends out the compounded one page of information to the printer controller 18, which controls the printer 19 on receiving the one page of information from CPU 17 to record the image information.

During recording by the printer 19, the CPU 17 receives the subsequent page of information.

Images are received and recorded in the manner as described above.

EXPERIMENT 1

Two parts by weight of conductive barium sulfate particles (barium sulfate particles having coating layers of tin oxide; $n_D$=1.7, the average particle diameter of primary particles=0.3 μm, and the thickness of a coating layer=0.015 μm) was mixed with 18 parts by weight of a resol type phenolic resin ($n_D$=1.7) and 10 parts by weight of methyl alcohol, and it was then dispersed for 20 hours therein. Afterward, a transparent polyethylene terephthalate (PET) film was coated with the prepared coating material, and then heated at 150° C. for 30 minutes to form a layer having a thickness of 15 μm thereon.

The transparency of thus formed layer was measured by an ultraviolet/visual spectrophotometer (Shimazu UV-2200, made by Shimadzu Seisakusho Ltd.). The result is shown in Table 1. It is apparent from the table that the above-mentioned layer, though being thick, has the sufficiently high transparency, and the loss of incident light by scattering is extremely small.

EXPERIMENTS 2 TO 4

The same procedure as in Experiment 1 was carried out except that the conductive particles shown in Table 1 were used, to form a resin layer containing the conductive particles. Transparency was then measured. The results are shown in Table 1. It is apparent that in every experiment, the transparency is sufficiently high, and the loss of incident light by scattering is extremely small.

COMPARATIVE EXPERIMENT 1

The same procedure as in Experiment 1 was carried out except that the conductive titanium oxide particles ($n_D$=2.6) were used as conductive particles, to form a resin layer containing the conductive particles. Transparency was then measured. The result is shown in Table 1.

Table 1

| | Conductive Particles | Difference of Refractive Index | Thickness of Layer (μm) | Transparency (%) 550 nm | Transparency (%) 700 nm |
|---|---|---|---|---|---|
| Experiment 1 | Conductive Barium Sulfate (barium sulfate formed with coating layers having tin oxide, $n_D = 1.7$) | 0 | 15 | 90 | 96 |
| Experiment 2 | Conductive Barium Sulfate (barium sulfate formed with coating layers having tin oxide, $n_D = 1.7$, av. particle diam. of prim. particles = 0.7 μm, thickness of coating layer = 0.02 μm) | 0 | 15 | 85 | 94 |
| Experiment 3 | Conductive Barium Sulfate (barium sulfate formed with coating layers having tin oxide and antimony compound, $n_D = 1.7$, av. particle diam. of prim. particles = 0.5 μm, thickness of coating layer = 0.02 μm) | 0 | 15 | 87 | 96 |
| Experiment 4 | Conductive Aluminum Oxide (aluminum oxide formed with coating layer having tin oxide and an antimony compound, $n_D = 2.0$, av. particle diam. of prim. particles = 0.3 μm, thickness of coating layer = 0.01 μm) | 0.3 | 15 | 80 | 88 |
| Comp. Exper. 1 | Conductive Titanium Oxide (titanium oxide formed with coating layers having tin oxide, $n_D = 2.6$, av. particle diam. of prim. particles = 0.5 μm, thickness of coating layer = 0.02 μm) | 0.8 | 15 | 1 | 3 |

EXPERIMENTS 5 AND 6

The same procedure as in Experiment 1 was carried out except that materials in Table 2 were used as a binding resin and a solvent, to form a resin layer containing the conductive particles. Transparency was then measured. In Experiment 6, the thickness of the layer was made 10 μm. The results are shown in Table 2.

TABLE 2

| | Binding Resin & Dispersion Solvent | Difference of Refractive Index | Thickness of Layer (μm) | Transparency (%) 550 nm | Transparency (%) 700 nm |
|---|---|---|---|---|---|
| Experiment 5 | Acrylic Resin (trade name Hitalloid 2605, made by Hitachi Chemical Co., Ltd., $n_D = 1.5$) & 1-methoxy-2-propanol | 0.2 | 15 | 86 | 95 |
| Experiment 6 | Epoxy Resin (trade name Dickfine EN-0270, made by Dainippon Ink & Chemicals, Inc., $n_D = 1.6$) & Water | 0.1 | 10 | 88 | 93 |

COMPARATIVE EXPERIMENT 2

The same procedure as in Experiment 6 was carried out except that conductive zinc oxide particles ($n_D$=2.0) were employed as the conductive particles, to form a resin layer containing the conductive particles. Transparency was then measured. The results are shown in Table 3.

TABLE 3

| | Conductive Particles | Difference of Refractive Index | Thickness of Layer (μm) | Transparency (%) 550 nm | 700 nm |
|---|---|---|---|---|---|
| Comp. Exper. 2 | Conductive Zinc Oxide ($n_D$ = 2.0) | 0.4 | 10 | 33 | 57 |

EXAMPLE 1

An aluminum cylinder (30 ϕ×260 mm) was coated, by dip coating, with a coating material prepared by dissolving 10 parts by weight of an alcohol-soluble polyamide (Amilan CM-8000, made by Toray Industries, Inc.) and 30 parts by weight of a methoxymethylated 6-nylon (Toresin EF-30T, made by Teikoku Chemical Co., Ltd.) in a mixed solvent of 150 parts by weight of methanol and 150 parts by weight of butanol, followed by dying at 90° C. for 10 minutes, to form a subbing layer having a thickness of 1 μm.

Next, 5 parts by weight of an azo pigment represented by the formula

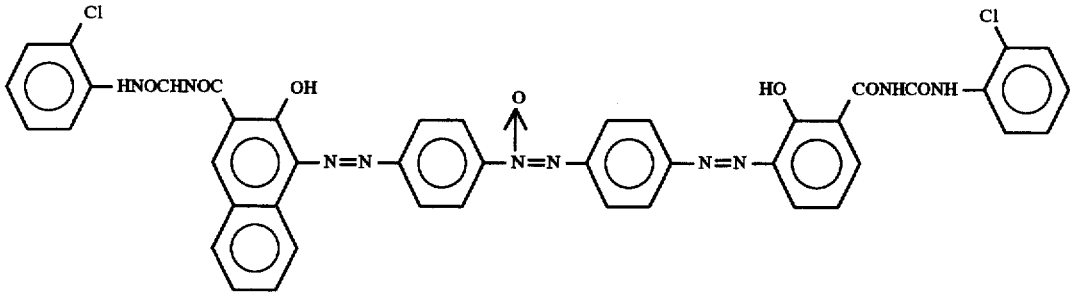

was dispersed in 90 parts by weight of tetrahydrofuran for 20 hours by means of a sand mill. A solution prepared by dissolving 2.5 parts by weight of a butyral resin (Eslec BL-S, made by Sekisui Chemical Co., Ltd.) in 20 parts by weight of tetrahydrofuran was then added to the resulting dispersion, followed by further dispersing for 2 hours. Next, 100 parts by weight of tetrahydrofuran and 100 parts by weight of cyclohexanone were added to this dispersion to obtain a diluted solution. Afterward, the above-mentioned subbing layer was coated with this diluted solution by dip coating, followed by drying at 80° C. for 10 minutes to form an electric charge generation layer having a thickness of 0.2 μm.

Next, 50 parts by weight of a styryl compound represented by the formula

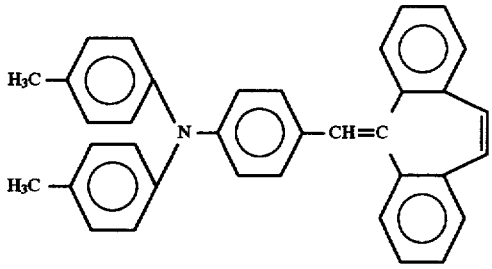

and 50 parts by weight of polycarbonate (Yuropin Z-200, made by Mitsubishi Gas Chemical Company Inc.) were dissolved in 400 parts by weight monochlorobenzene, and the above-mentioned electric charge generation layer was coated with the resulting solution by dip coating, followed by drying at 120° C. for 1 hour, to form a charge transfer layer having a thickness of 20 μm.

Next, 50 parts by weight of conductive barium sulfate having a coating layer containing tin oxide($n_D$=1.7) used in Experiment 1, 50 parts by weight of an acrylic monomer represented by the formula

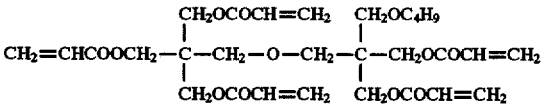

($n_D$ of a polymer obtained by the polymerization reaction of this monomer=1.5), 0.05 part by weight of 2-methylthioxanthone as a photochemical reaction initiator and 150 parts by weight of toluene were mixed, and the resulting mixture was then dispersed for 70 hours by a sand mill to obtain a coating material. The above-mentioned charge transporting layer was coated with the thus obtained coating material by spray coating, and after drying, the coating material was irradiated with light for 20 seconds at the light intensity of 8 mW/cm$^2$ by the use of a high-pressure mercury vapor lamp to form a protective layer having a thickness of 5 μm.

When the coating material for the protective layer was stored for a long period of time, the conductive particles neither cohered nor settled, and the viscosity of the coating material did not change. In short, the coating material could maintain stable characteristics.

The thus prepared electrophotographic photosensitive member was set on a copyer in which a serial process of charging-exposure-development-transfer-cleaning was repeated in a cycle of 1.5 seconds, and the evaluation of electrophotographic properties and the visual evaluation of the images obtained at normal temperature•normal humidity (N/N) of a temperature of 20° C. and a humidity of 50%, at the low temperature•low humidity (L/L) of a temperature of 10° C. and a humidity of 15%, and at the high temperature•high humidity (H/H) of a temperature of 35° C. and a humidity of 85%. In addition, the durability test of repeating image formation at normal temperature•normal humidity was made as much as 100,000 sheet copying. As a result, it was apparent that the sensitivity and residual potential of this photosensitive member were equal to those of an electrophotographic photosensitive member not having the surface layer as in Comparative Example 3 given later, and the excellent images without uneven density or black dots could be obtained under the respective environments. Even when the photosensitive member was repeatedly used as much as 100,000 sheet copying, the excellent images could be stably obtained. The results are shown in Table 4. In this table, dark potential ($V_D$) is the surface potential of the photosensitive member at the time when this member is charged by a corona discharge of −5 KV, sensitivity (Ey) is a luminous exposure necessary to reduce the surface potential to y, and residual potential (Vr) is the surface potential of the photosensitive member after preexposure.

EXAMPLE 2

The same procedure as in Example 1 was carried out except that conductive barium sulfate ($n_D$=1.7) used in Experiment 2 was employed as the conductive particles, to form a electrophotographic photosensitive member, and evaluation was then made. The results are shown in Table 4.

EXAMPLE 3

The same procedure as in Example 1 was carried out except that conductive mica (which was provided with coating layers having tin oxide, $n_D$=1.8) was employed as the conductive particles, to form a electrophotographic photosensitive member, and evaluation was then made. The results are shown in Table 4.

EXAMPLE 4

The same procedure as in Example 1 was carried out except that a protective layer was formed as follows, to form a electrophotographic photosensitive member, and evaluation was then made.

A mixture of 50 parts by weight of conductive barium sulfate used in Example 1, 50 parts by weight of an ammonia resol resin (Phenolite J-325, made by Dainippon Ink & Chemicals. Inc., $n_D$=1.6) and 100 parts by weight of methanol were dispersed for 20 hours by means of a sand mill to form a coating material. Next, a charge transporting layer was coated with this coating material by spray coating, and the coating material was then heated at 140° C. for 30 minutes to be cured, thereby forming a protective layer having a thickness of 5 μm.

The results are shown in Table 4.

COMPARATIVE EXAMPLE 1

The same procedure as in Example 1 was carried out except that any protective layer was not provided, to form a electrophotographic photosensitive member, and evaluation was then made. As a result, the density of images was thin, and under conditions of high temperature and high humidity, smeared image occurred from the early stage.

COMPARATIVE EXAMPLE 2

The same procedure as in Example 1 was carried out except that conductive zinc oxide particles ($n_D$=2.0) used in Comparative Experiment 2 were used as the conductive particles, to form a electrophotographic photosensitive member, and evaluation was then made. As a result, sensitivity became low, and under the conditions of high temperature and high humidity, black dots appeared on images.

TABLE 4

| | Difference | Electrophotographic Characteristics | | |
|---|---|---|---|---|
| | of Refractive Index | $V_D$ (V) | N/N E½ (lux · sec) | Vr (V) |
| Example 1 | 0.2 | −1030 | 1.72 | −15 |
| Example 2 | 0.2 | −1020 | 1.73 | −10 |
| Example 3 | 0.3 | −1000 | 1.78 | −15 |
| Example 4 | 0.1 | −1050 | 1.75 | −20 |
| Comp. Ex. 1 | — | −970 | 1.70 | −10 |
| Comp. Ex. 2 | 0.5 | −1000 | 4.13 | −45 |

| | Evaluation of Images | | | |
|---|---|---|---|---|
| | N/N | | | |
| | Initial | after 100,000 Sheets | L/L Initial | H/H Initial |
| Example 1 | Good | Good | Good | Good |
| Example 2 | Good | Good | Good | Good |
| Example 3 | Good | Good | Good | Good |
| Example 4 | Good | Good | Good | Good |
| Comp. Ex. 1 | Good | Image density was thin. | Good | Image flow occurred. |
| Comp. Ex. 2 | Good | Good | Good | Black dots occurred. |

What is claimed is:

1. An electrophotographic photosensitive member comprising a conductive support, a photosensitive layer provided on the conductive support and a protective layer provided on the photosensitive layer, said protective layer being composed of electroconductive particles and a binding resin, wherein the difference between reflective index of the electroconductive particles and that of the binding resin is 0.3 or less and wherein each electroconductive particle comprises a base particle and a layer containing a conductive material provided on the surface of the base particle.

2. An electrophotographic photosensitive member according to claim 1, wherein the difference between the refractive index of the conductive particles and that of the binding resin is 0.2 or less.

3. An electrophotographic photosensitive member according to claim 1, wherein the base particles of the conductive particles are made of an inorganic material.

4. An electrophotographic photosensitive member according to claim 3, wherein the base particles of the conductive particles are made of barium sulfate.

5. An electrophotographic photosensitive member according to claim 1, wherein the base particles of the conductive particles are made of barium sulfate.

6. An electrophotographic photosensitive member according to claim 1, wherein the conductive material is selected from the group consisting of metal oxides and metals.

7. An electrophotographic photosensitive member according to claim 1, wherein the layer containing the conductive material has a thickness of from 0.002 to 0.1 μm.

8. An electrophotographic photosensitive member according to claim 7, wherein the layer containing the conductive material has a thickness of from 0.005 to 0.02 μm.

9. An electrophotographic photosensitive member accordingly to claim 1, wherein the conductive particles have a primary particle diameter from 0.1 to 1.0 μm.

10. An electrophotographic photosensitive member accordingly to claim 9, wherein the conductive particles have a primary particle diameter from 0.3 to 0.7 μm.

11. An electrophotographic apparatus, comprising an electrophotographic photosensitive member, a means for forming an electrostatic latent image, a means for developing the formed electrostatic latent image, and a means for transferring the developed image to a transfer material;

said electrophotographic photosensitive member comprising an electroconductive support, a photosensitive layer provided on the electroconductive support and a protective layer provided on the photosensitive layer, said protective layer being composed of electroconductive particles and a binding resin, the difference between the refractive index of the electroconductive particles and that of the binding resin being 0.3 or less and wherein each electroconductive particle comprises a base particle and a layer containing a conductive material provided on the surface of the base particle.

12. An integrated device unit detachable from a main body of an apparatus comprising: an electrophotographic photosensitive member and at least one means selected from the group consisting of a charging means, a developing means and a cleaning means;

said electrophotographic photosensitive member comprising an electroconductive support, a photosensitive layer provided on the electroconductive support and a protective layer provided on the photosensitive layer, said protective layer being composed of electroconductive particles and a binding resin, the difference between the refractive index of the electroconductive particles and that of the binding resin being 0.3 or less and wherein each electroconductive particle comprises a base particle and a layer containing a conductive material provided on the surface of the base particle.

* * * * *

UNITED STATES PATENT AND TRADEMARK OFFICE

CERTIFICATE OF CORRECTION

PATENT NO. : 5,695,898

DATED : December 9, 1997

INVENTOR(S): SHINTETSU GO ET AL.

It is certified that error appears in the above-identified patent and that said Letters Patent is hereby corrected as shown below:

COLUMN 1:
Line 26, "the" (second occurrance) should be deleted;
Line 57, "Gives" should read --gives--.

COLUMN 3:
Line 14, "is" should read --are--.

COLUMN 4:
Line 17, "Compounds" should read --compounds--;
Line 26, "above" should read --above---;
Line 38, "minium" should read --minum--;
Line 52, "Graphite" should read --graphite--;
Line 54, "above" should read --above---.

COLUMN 5:
Line 4, "0.1-50 μm." should read --0.1-50 μm,--;
Line 41, "exiting of" should read --exiting--;
Line 49, "above described" should read --above-described--.

UNITED STATES PATENT AND TRADEMARK OFFICE

CERTIFICATE OF CORRECTION

PATENT NO. : 5,695,898

DATED : December 9, 1997

INVENTOR(S): SHINTETSU GO ET AL.

It is certified that error appears in the above-identified patent and that said Letters Patent is hereby corrected as shown below:

COLUMN 11:

Line 15, "copyer" should read --copier--;
Line 39, "(Ey)" should read --(E½)--;
Line 48, "a" should read --an--;
Line 55, "a" should read --an--;
Line 63, "a" should read --an--.

COLUMN 12:

Line 12, "a" should read --an--;
Line 22, "a" should read --an--;
Line 59, "reflective" should read --the refractive--.

Signed and Sealed this

FourthDay of August, 1998

Bruce Lehman

*Attest:*

BRUCE LEHMAN

*Attesting Officer*

*Commissioner of Patents and Trademarks*